United States Patent [19]

Moshos et al.

[11] Patent Number: 4,972,542

[45] Date of Patent: Nov. 27, 1990

[54] TOOTHBRUSH APPARATUS

[76] Inventors: Panagiotis N. Moshos; Quinella Moshos, both of 1403 E. 55th St., Tacoma, Wash. 98404

[21] Appl. No.: 309,490

[22] Filed: Feb. 13, 1989

[51] Int. Cl.[5] ..... A46B 17/02

[52] U.S. Cl. ..... 15/167.2; 15/176.6

[58] Field of Search ..... 15/167.1, 167.2, 176.1, 15/176.6

[56] References Cited

U.S. PATENT DOCUMENTS

| | | | |
|---|---|---|---|
| 1,407,214 | 2/1922 | Osborn | 15/176.6 |
| 1,731,751 | 10/1929 | Neissl | 15/176.1 |
| 1,797,946 | 3/1931 | Eichel | 15/176.1 |
| 1,928,328 | 9/1933 | Carpentier | 15/167.1 |
| 2,093,383 | 9/1937 | Rudof et al. | 15/167.2 |
| 2,588,601 | 3/1952 | Zavagno | 15/167.2 |
| 2,701,380 | 2/1955 | Ripper | 15/167.2 |
| 2,771,624 | 11/1956 | Ripper | 15/167.2 |
| 2,807,820 | 10/1957 | Dinhofer | 15/176.1 |
| 3,065,479 | 11/1962 | McGee | 15/167.2 |
| 3,271,805 | 9/1966 | Sawyer | 15/176.1 |
| 3,732,589 | 5/1973 | Burki | 15/167.2 |

FOREIGN PATENT DOCUMENTS

| | | | |
|---|---|---|---|
| 2595221 | 9/1987 | France | 15/167.1 |

*Primary Examiner*—Harvey C. Hornsby
*Assistant Examiner*—Mark Spisich
*Attorney, Agent, or Firm*—Leon Gilden

[57] ABSTRACT

A toothbrush apparatus is set forth wherein a toothbrush head containing orthogonally oriented bristles is received and locked within a central body provided with hinged plates each containing outwardly extending bristles hingedly secured to the central body including a plurality of bendable wires extending through the central body and associated plates to manipulate and configure the plates relative to the body in a selective predetermined orientation.

1 Claim, 1 Drawing Sheet

TOOTHBRUSH APPARATUS

BACKGROUND OF THE INVENTION

1. Field of the Invention

The field of invention relates to toothbrush apparatus, and more particularly pertains to a new and improved toothbrush apparatus wherein the same utilizes a conventionally configured toothbrush in selective association with an adjunct containing a plurality of obtusely positioned plates each containing bristles to configure the plate bristles at a desired orientation relative to the toothbrush head bristles.

2. Description of the Prior Art

The use of various toothbrush apparatus to accommodate a variety of dental conditions is well known in the prior art. The toothbrush apparatus of the prior art has utilized a toothbrush arrangement generally specialized to apply to particular situations requiring the employment and storage of multiple toothbrush apparatus arrangements to accommodate the myriad of dental situations encountered by users of such apparatus. For example, U.S. Pat. No. 2,588,601 to Zavagno sets forth a toothbrush provided with a plurality of wires extending therethrough containing at its terminal ends thereof a plurality of additional toothbrush heads. The Zavagno patent does not provide for the releasable securement of the toothbrush to enable the toothbrush head to be utilized without the utilization of the associated heads. Further, as opposed to the instant invention, the Zavagno patent does not utilize elongate hinges to secure the additional heads to the toothbrush whereby appropriate longitudinal alignment of the additional heads is not readily available.

U.S. Pat. 2,701,380 to Ripper sets forth a "U" shaped attachment containing bristles at its interior surfaces for securement to a toothbrush by means of a connector. The Ripper patent does not provide for the configuration of the additional heads of bristles as set forth by the instant invention.

U.S. Pat. No. 2,771,624 to Ripper sets forth a "U" shaped head for securement to an elongate toothbrush utilizing a variation of securement means, as opposed to the formerly noted Ripper patent No. 2,701,380.

U.S. Pat. No. 3,065,479 to McGee sets forth a toothbrush arrangement wherein a toothbrush head utilizing spaced "U" shaped bristle arrangements accommodates the curvilinear configuration of the teeth of an individual wherein the trailing "U" shaped head is pivotally mounted relative to the forwardly positioned head.

U.S. Pat. No. 8,732,589 to Burki sets forth a toothbrush tool wherein a rotatably mounted head is of a generally "H" shaped cross-sectional configuration to enable simultaneous brushing of upper and lower teeth.

As such, it may be appreciated that there continues to be a need for a new and improved toothbrush apparatus wherein the same addresses both the problems of versatility and compactness of organization, and in this respect, the present invention substantially fulfills this need.

SUMMARY OF THE INVENTION

In view of the foregoing disadvantages inherent in the known types of toothbrush apparatus now present in the prior art, the present invention provides a toothbrush apparatus wherein the same provides for a manually manipulatable "U" shaped toothbrush adjunct selectively securable to a conventionally configured toothbrush. As such, the general purpose of the present invention, which will be described subsequently in greater detail, is to provide a new and improved toothbrush apparatus which has all the advantages of the prior art toothbrush apparatus and none of the disadvantages.

To attain this, the present invention comprises a toothbrush apparatus wherein a toothbrush head of conventional configuration is provided with longitudinal flanges interfitting with a central head of a "U" shaped adjunct wherein the head is lockable in a preselected position by means of a hinged clip formed with forwardly mounted projection to cooperate with a recess formed in an exterior surface of the toothbrush head. The "U" shaped adjunct is provided with hingedly mounted plates manually manipulatable into a predetermined configuration utilizing a plurality of wires positioned through the head to maintain the configuration when arranged by an individual.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved toothbrush apparatus which has all the advantages of the prior art toothbrush apparatus and none of the disadvantages.

It is another object of the present invention to provide a new and improved toothbrush apparatus which may be easily and efficiently manufactured and marketed.

It is a further object of the present invention to provide a new and improved toothbrush apparatus which is of a durable and reliable construction.

An even further object of the present invention is to provide a new and improved toothbrush apparatus which is susceptible of a low cost of manufacture with regard to both materials and labor, and which accordingly is then susceptible of low prices of sale to the consuming public, thereby making such toothbrush apparatus economically available to the buying public.

Still yet another object of the present invention is to provide a new and improved toothbrush apparatus which provides in the apparatuses and methods of the prior art some of the advantages thereof, while simultaneously overcoming some of the disadvantages normally associated therewith.

Still another object of the present invention is to provide a new and improved toothbrush apparatus wherein the same sets forth a toothbrush selectively securable and utilized with a manually manipulatable adjunct to accommodate configurational changes to the "U" shaped adjunct.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2, 3, 4, 5:
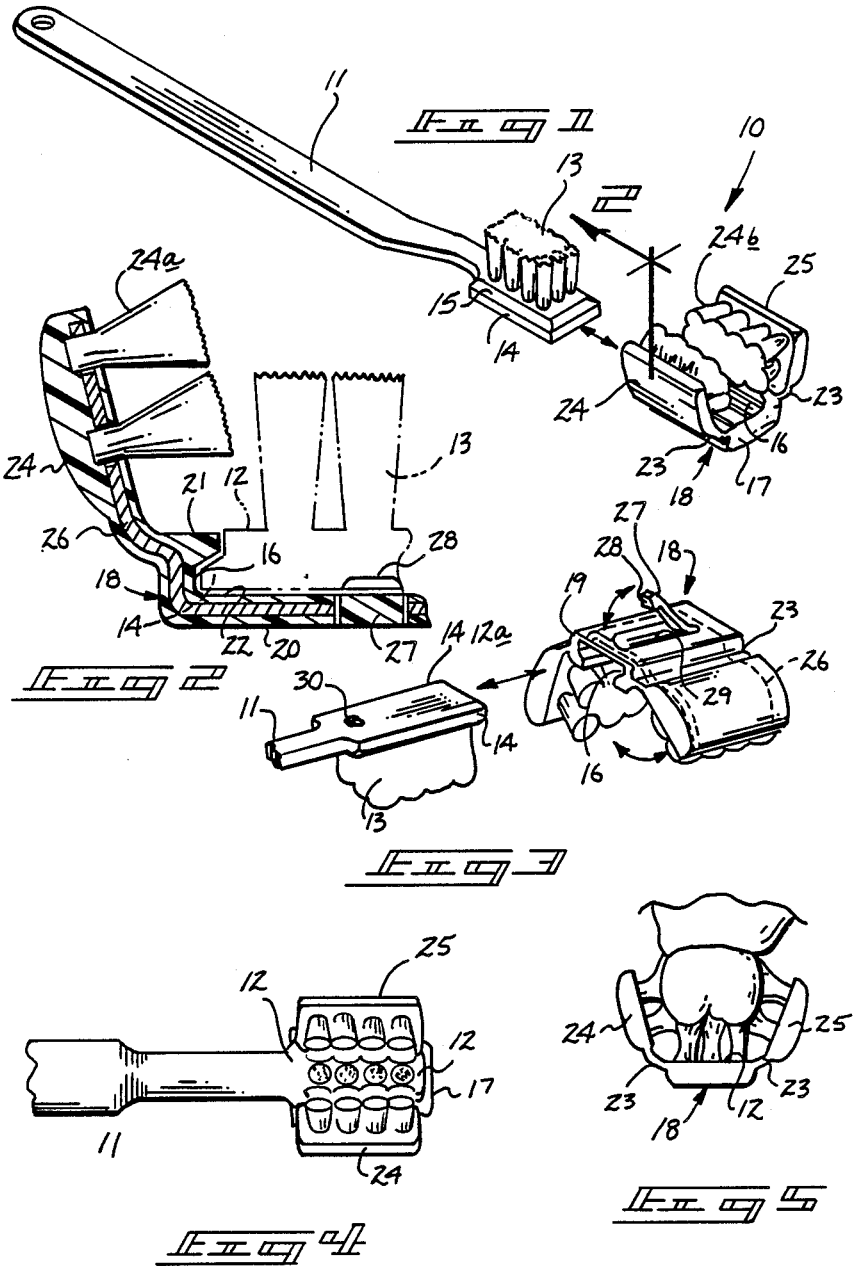
FIG. 1 is an isometric illustration of the instant invention.
FIG. 2 is an orthographic cross-sectional view taken on the section 2 of FIG. 1 in the direction indicated by the arrow.
FIG. 3 is an isometric illustration of the rear faces of the toothbrush and adjunct.
FIG. 4 is a top orthographic view of the toothbrush apparatus in an assembled configuration.
FIG. 5 is an orthographic end view of the toothbrush apparatus in an assembled configuration.

With reference now to the drawings, and in particular to FIGS. 1 to 5 thereof, a new and improved toothbrush apparatus embodying the principles and concepts of the present invention and generally designated by the reference numeral 10 will be described.

More specifically, it will be noted that the toothbrush apparatus 10 essentially comprises an elongate longitudinally oriented handle 11 formed with an enlarged head 12 at a forward distal end thereof. The head 12 includes a plurality of orthogonally upwardly extending head bristles 13. The head is formed with a plurality of parallel flanges 14 coextensive with the sides of the head 12 extending outwardly and aligned with the rear face 12*a* of the head 12. The flanges 14 define elongate recesses 15 defined between the flanges 14 and the upper surface of the head 12 containing the bristles.

The head 12 is receivable within an adjunct formed with elongate spaced parallel slots 16 spaced a distance apart approximately equal to that of the exterior edges defined by the flanges 14 to receive the flanges 14 therewithin with an overlying body flange 21 received within the recesses of the head 12. The adjunct is formed with a central body 18 formed with a forward wall 17 terminating the forwardmost length of the slot 16 with a rear wall 19 defining the origin of the inwardly extending parallel slot 16. The slot 16 is of a length equal to that of the flanges 14 to thereby completely receive the head 12 within the central body 18. A bottom wall 20 defines the outer face of the central body 18 and is formed with an elongate slot 29 with a hinged clip hingedly mounted to a forward end of the slot 29 wherein the clip is formed with a forward projection 28 extending interiorly of the bottom wall 20 and of the slot 29. An interior surface 22 of the central body 18 slidingly receives the rear face 12*a* of the head 12 therealong and is formed with a blind recess 30 to receive the forward projection 28 therewithin and thereby latch the head 12 within the central body 18.

Extending longitudinally of the central body 18 formed integrally therewith are reduced thickness hinges coextensive with the central body 18 hingedly securing a first plate adjacent one elongate side of the central body 18 and a parallel spaced second plate at the other side of the central body formed at generally obtuse angles relative to the interior surface 22 of the central body 18. Each of the first and second plates is formed with respective first plate bristles 24*a* and second plate bristles 24*b* extending interiorly of the "U" shaped configuration defined by the central body 18 and the first and second plates 24 and 25. Extending coextensively with the width of the central body 18, hinges 23, and plates 24 and 25 are spaced parallel and malleable metallic strips 26 to enable angulation of the plates 24 and 25 relative to the central body 18 to accommodate variations in tooth configuration, as illustrated in FIG. 5 for example. The metallic strips are positioned on opposite sides of the elongate slot 29 and wherein the elongate hinges maintain the alignment of the first and second plates 24 and 25 with respect to the central body and prevent skewing of the respective first and second plates 24 and 25 relative to the central body 18. The metallic strips 26 are completely encased within the polymeric central body 18, hinges 23, and plates 24 and 25 thereby preventing corrosion and the like of the metallic strips maintaining the structural integrity of the metallic strips to enable repetitive reconfiguration of the respective first and second plates 24 and 25 relative to the central body 18. Further, the metallic strips are aligned orthogonally relative to the longitudinal "U" shaped body adjunct and ar preferably formed of memory retentent metallic material to enable the plates 24 and 25 to maintain an orientation relative to the central body 18 at a predetermined obtuse angle thereto when so configured by a user of the apparatus.

Accordingly, the bristles 13 are oriented to brush a tooth's top surface while the respective first and second plate bristles 24*a* and 24*b* engage forward and rear surfaces of the associated teeth to be brushed in a surrounding relationship.

As to the manner of usage and operation of the instant invention, the same should be apparent from the above description and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A toothbrush apparatus comprising a toothbrush member including an elongate longitudinally extending handle formed with an enlarged head at a terminal forwardmost end of the handle wherein the enlarged head is formed with head bristles extending upwardly and orthogonally of a top surface of the head, and elongate parallel flanges extending coextensively and outwardly of side surfaces of the head, the flanges oriented orthogonally relative to the top surface, and a "U" shaped adjunct formed with a central body, and first and second plate members hingedly secured to the central body and coextensively formed to side edges of the central body, and the central body including an elongate "U" shaped central slot defined by a "U" shaped wall, the central slot including elongate further slots directed interiorly of the "U" shaped wall to receive the flanges formed to the side surfaces of the head, and wherein the elongate slots are parallel to one another and spaced a distance substantially equal to the spacing of the flanges, and the "U" shaped wall is formed with a forward wall forming an abutment wall orthogonally across forward ends of the elongate slots with the central body formed with a rearwardly oriented parallel rear wall parallel to the forward wall with the central slot and the elongate slots extending through the rear wall for reception of the parallel flanges and head within the central body, and wherein the central slot is of a predetermined length substantially equal to a further length defined by the head, and wherein the head is formed with a rear face slidingly receivable in alignment with a bottom wall of the central body wherein the bottom wall has formed therethrough a slot and a clip, and wherein the clip is hingedly mounted within and to a forward end of the slot, and a projection integrally formed onto the clip extending interiorly of and through the bottom wall and receivable within a recess formed on the rear face of the head when the head is secured within the central body, and wherein the first and second plates and central body have orthogonally positioned therethrough a plurality of metallic strips, said metallic strips parallel to one another and malleable to define a memory retentent configuration to the adjunct, and wherein the adjunct is formed of polymeric material and completely encases the metallic strips, and wherein each of the first and second plates is formed with respective bristles extending interiorly of the "U" shaped adjunct to cooperate with the head bristles of the head.

* * * * *